US009435062B2

(12) United States Patent
Kongo

(10) Patent No.: US 9,435,062 B2
(45) Date of Patent: Sep. 6, 2016

(54) SEWING MACHINE SYSTEM, SEWING MACHINE, AND RECORDING MEDIUM HAVING PROGRAM STORED THEREIN

(71) Applicant: Janome Sewing Machine Co., Ltd., Tokyo (JP)

(72) Inventor: Takeshi Kongo, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 3 days.

(21) Appl. No.: 14/500,510

(22) Filed: Sep. 29, 2014

(65) Prior Publication Data

US 2015/0345057 A1 Dec. 3, 2015

(30) Foreign Application Priority Data

Jun. 3, 2014 (JP) ..... 2014-114634

(51) Int. Cl.

| | |
|---|---|
| ***D05B 19/12*** | (2006.01) |
| ***D05B 59/00*** | (2006.01) |
| ***D05B 43/00*** | (2006.01) |
| ***D05B 19/04*** | (2006.01) |

(52) U.S. Cl.

CPC ..... *D05B 59/00* (2013.01); *D05B 19/04* (2013.01); *D05B 19/12* (2013.01); *D05B 43/00* (2013.01); *D05D 2207/00* (2013.01)

(58) Field of Classification Search

CPC .... D05B 19/08; D05B 19/085; D05B 19/12; D05B 21/00; D05B 91/14; D05B 91/16; D05B 47/00; D05B 51/00; D05B 43/00; D05B 65/00; D05B 2207/00; D05B 2305/00; D05B 59/00; D05B 19/04; B65H 2701/31; B65H 75/18; B65H 49/04; B65H 49/32; D05C 11/00; D05C 11/16; D05C 3/02; G05B 2219/2626; G05B 2219/45195; D05D 2207/00; D05D 2305/00; D05D 2303/40

See application file for complete search history.

(56) References Cited

U.S. PATENT DOCUMENTS

| | | | | |
|---|---|---|---|---|
| 4,166,423 | A * | 9/1979 | Brienza | B65H 75/18 112/254 |
| 4,869,188 | A * | 9/1989 | Hyodo | D05B 51/00 112/445 |
| 7,000,868 | B1 * | 2/2006 | Moore | B65H 49/32 112/254 |
| 7,918,387 | B2 * | 4/2011 | Kahn | D05C 11/00 235/375 |
| 7,983,782 | B2 * | 7/2011 | Nomura | B65H 49/04 700/136 |
| 2004/0000264 | A1 * | 1/2004 | Sakakibara | D05B 43/00 112/470.06 |

(Continued)

FOREIGN PATENT DOCUMENTS

| | | |
|---|---|---|
| JP | H07-155487 A | 6/1995 |
| JP | 4775483 B2 | 9/2011 |

*Primary Examiner* — Ismael Izaguirre
(74) *Attorney, Agent, or Firm* — Nakanishi IP Associates, LLC

(57) ABSTRACT

Provided is a sewing machine system including: a container case having a plurality of containers partitioned in a grid pattern; a detecting unit configured to detect a type of a thread spool contained in any of the containers and a contained position of the thread spool in the container case in association with each other; a detection result transmitting unit configured to transmit a result of the detection by the detecting unit to the sewing machine; a sewing machine provided separately from the container case; a detection result receiving unit provided for the sewing machine, and configured to receive the detection result from the detection result transmitting unit; and a display unit configured to display a type of a thread spool to be required during sewing and a contained position of the thread spool in the container case.

7 Claims, 10 Drawing Sheets

(56) References Cited

U.S. PATENT DOCUMENTS

2005/0188906 A1* 9/2005 Goto ..... D05C 11/16
112/102.5
2007/0295253 A1* 12/2007 Hayakawa ..... D05C 3/02
112/102.5
2010/0017011 A1* 1/2010 Goldman ..... D05B 19/12
700/138
2010/0313803 A1* 12/2010 Okuyama ..... D05B 19/12
112/102.5
2011/0048300 A1* 3/2011 Tokura ..... D05B 19/12
112/102.5
2011/0048304 A1 3/2011 Kato et al.

* cited by examiner

Fig.6

| THREAD NUMBER | LINE-COLUMN ADDRESS NUMBER |
|---|---|
| 001 | a1 |
| 002 | e1 |
| 003 | e4 |
| 201 | b4 |
| 205 | a3 |
| 209 | b2 |
| 210 | b1 |
| 217 | c3 |
| 218 | c2 |
| 226 | d2 |

Fig.7

| | a | b | c | d | e | f | g | h |
|---|---|---|---|---|---|---|---|---|
| 8 | | | | | | | | |
| 7 | | | | | | | | |
| 6 | | | | | | | | |
| 5 | | | | | | | | |
| 4 | | 201 | | | 003 | | | |
| 3 | 205 | | 217 | | | | | |
| 2 | 226 | 209 | 218 | 226 | | | | |
| 1 | 001 | 210 | 205 | | 002 | | | |

SEWING MACHINE SYSTEM, SEWING MACHINE, AND RECORDING MEDIUM HAVING PROGRAM STORED THEREIN

CROSS REFERENCE TO RELATED APPLICATIONS

This application is based on and claims the benefit of priority to Japanese Patent Application No. 2014-114634 filed on Jun. 3, 2014, the contents of which are hereby incorporated by reference in their entirety.

TECHNICAL FIELD

The present invention relates to a sewing machine system, a sewing machine, and a recording medium having a program stored therein.

BACKGROUND ART

Conventionally, when a pattern is embroidered using an embroidery sewing machine, threads of a plurality of colors are usually used. In order to closely re-create embroidery data produced based on an original design (original drawing) using an embroidery sewing machine, threads of colors specified in data production must be used. Further, in order to express sensitive differences in colors, it is necessary to use a large number of colors, sometimes nearly 100 different colors. Each of thread spools has a label indicating a number of the thread (color of the thread) or an imprinted thread number, and a desired thread is to be searched based on this number.

The search of a thread spool occurs every time the color changes, and it is necessary to find a desired thread spool referring to the thread number or the color name in each case. Unfortunately, when the number of colors of the thread spools increases as described above, searching a desired thread spool is cumbersome work as it requires painful efforts.

In order to facilitate the work of searching of thread spools, Patent Literature 1 proposes a thread spool standing device for moving a predetermined thread spool to the front side by motor control.

Alternatively, Patent Literature 2 proposes a thread spool storing device that indicates a place at which a predetermined thread spool is stored by an LED through a sewing machine and a communicating means.

PRIOR ART LITERATURE

Patent Literature

[Patent Literature 1] Japanese Patent Application Laid-Open No. H07-155487

[Patent Literature 2] Japanese Patent No. 4775483

SUMMARY OF THE INVENTION

The technique disclosed in Patent Literature 1 or 2 described above is a large device or system, however, and not easily to put into practice. In addition, the above conventional techniques require previous preparation such as setting thread spools at predetermined places, and indicating a relation between a storage chamber and a thread color, and there is a issue that such preparation itself is highly cumbersome.

One or more embodiments of the present invention provide a sewing machine system, a sewing machine, and a recording medium having a program stored therein, all of which are capable of facilitating searching of a required thread spool when a thread is changed during sewing, and can be easily implemented.

Embodiment (1): One or more embodiments of the present invention provide a sewing machine system including: a sewing machine for forming stitching; a container case provided separately from the sewing machine, and having a plurality of containers partitioned in a grid pattern; a detecting unit configured to detect a type of a thread spool contained many of the containers and a contained position of the thread spool in the container case in association with each other; a detection result transmitting unit configured to transmit a result of the detection by the detecting unit to the sewing machine; a detection result receiving unit provided for the sewing machine, and configured to receive the detection result from the detection result transmitting unit; and a display unit configured to display, based on the detection result, a type of a thread spool to be required during sewing and a contained position of the thread spool in the container case.

Embodiment (2): One or more embodiments of the present invention provide the sewing machine system of the embodiment (1), wherein the detecting unit and the detection result transmitting unit are provided for a detecting device separate from the container case and the sewing machine, the detecting device includes an image taking unit configured to take an image of positional indications for specifying positions of the containers of the container case, and of a type indication shown on a thread spool contained in the container and for specifying a type of the thread spool, and the detecting unit detects, using a result of the image taken by the image taking unit, the type of the thread spool contained in any of the containers and the contained position of the thread spool in the container case in association with each other.

Embodiment (3): One or more embodiments of the present invention provide the sewing machine system of the embodiment (1), wherein the display unit is provided for the sewing machine.

Embodiment (4): One or more embodiments of the present invention provides the sewing machine system of the embodiment (2), wherein the sewing machine includes a thread spool information transmitting unit configured to transmit information relating to the type of the thread spool to be required during sewing and the contained position of the thread spool in the container case to the detecting device, the detecting device includes: a thread spool information receiving unit configured to receive the information from the thread spool information transmitting unit; and a display unit configured to display, based on the information received by the thread spool information receiving unit, the type of the thread spool to be required during sewing and the contained position of the thread spool in the container case.

Embodiment (5): One or more embodiments of the present invention provide the sewing machine system of the embodiment (1), wherein the detecting unit and the detection result transmitting unit are provided for the container case, and the detecting unit includes reading units respectively provided for the containers, and by the reading units respectively communicating with RFID chips each provided for thread spools contained in the container case, detects a type of a thread spool contained in any of the containers and the contained position of the thread spool in the container case in association with each other.

Embodiment (6): One or more embodiments of the present invention provide a sewing machine provided for a sewing machine system including: the sewing machine for forming stitching; a container case provided separately from the sewing machine, and having a plurality of containers partitioned in a grid pattern; a detecting unit configured to detect a type of a thread spool contained many of the containers and a contained position of the thread spool in the container case in association with each other; and a detection result transmitting unit configured to transmit a result of the detection by the detecting unit to the sewing machine, the sewing machine including: a detection result receiving unit configured to receive the detection result from the detection result transmitting unit; and a display unit configured to display, based on the detection result, a type of a thread spool to be required during sewing and a contained position of the thread spool in the container case.

Embodiment (7): One or more embodiments of the present invention provide a recording medium having a program stored therein for causing a detecting device of the sewing machine system of the embodiment (2) to be operated, the program causing a computer to execute the steps of: causing the image taking unit to take an image of positional indications for specifying positions of the containers of the container case, and of a type indication shown on a thread spool contained in the container and for specifying a type of the thread spool; causing the detecting unit to detect, using a result of the image taken by the image taking unit, the type of the thread spool contained in any of the containers and the contained position of the thread spool in the container case in association with each other; and causing the detection result transmitting unit to transmit a result of the detection by the detecting unit to the sewing machine.

According to one or more embodiments of the present invention, it is possible to provide a sewing machine system, a sewing machine, and a recording medium having a program stored therein, all of which are capable of facilitating searching of a required thread spool when a thread is changed during sewing, and can be easily implemented.

BRIEF DESCRIPTION OF THE DRAWINGS

FIG. 6 is an example of a "thread number/line-column address number" conversion table generated for the example shown in FIG. 4;

FIG. 7 is a display example in the tablet terminal 30;

DETAILED DESCRIPTION OF PREFERRED EMBODIMENTS

Hereinafter, embodiments for implementing the present invention will be described with reference to the drawings.

First Embodiment

Figure 1:
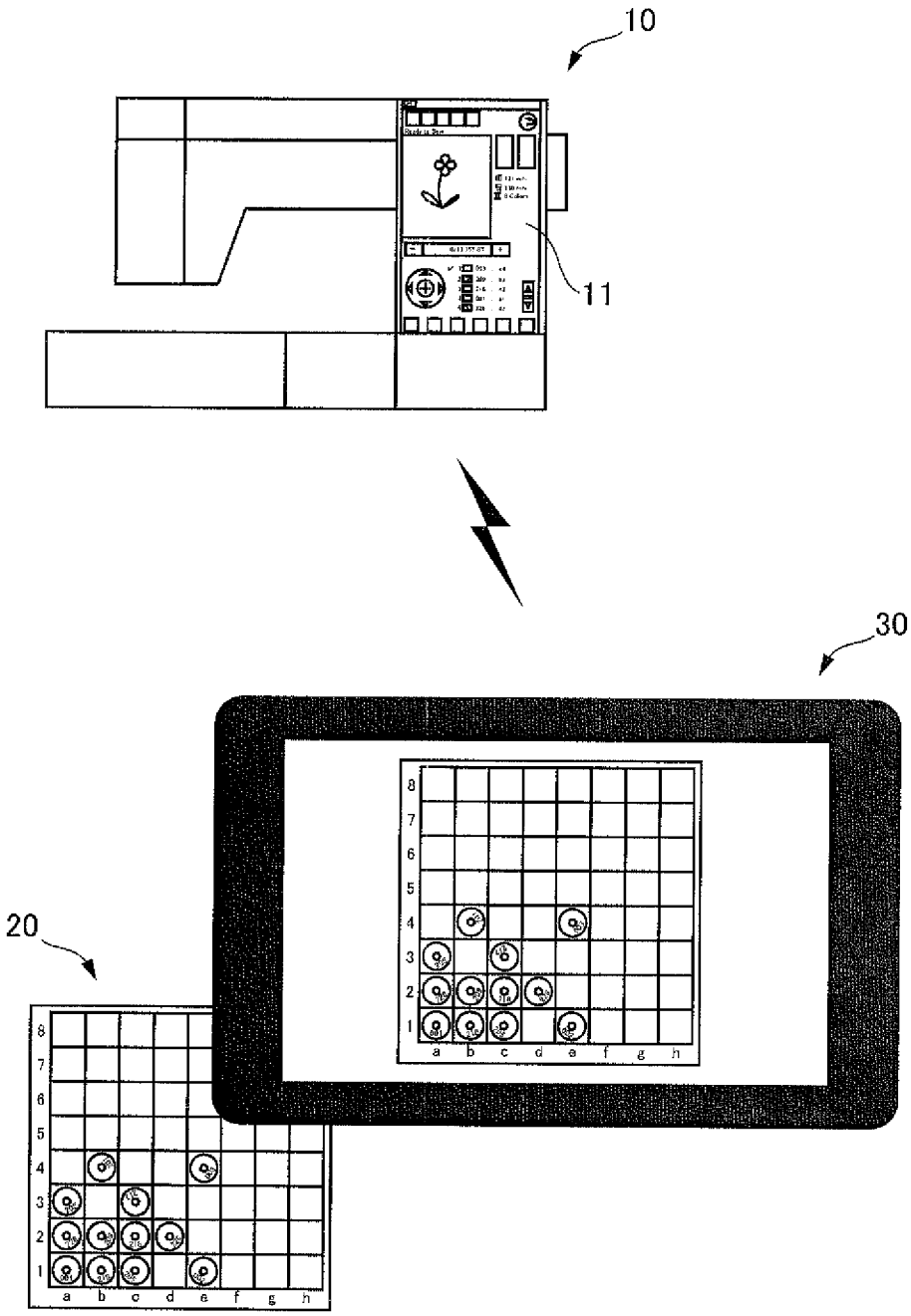
FIG. 1 is illustration of a sewing machine system of a first embodiment according to the present invention.

FIG. 1 is illustration of a sewing machine system of a first embodiment according to the present invention.

Figure 2:
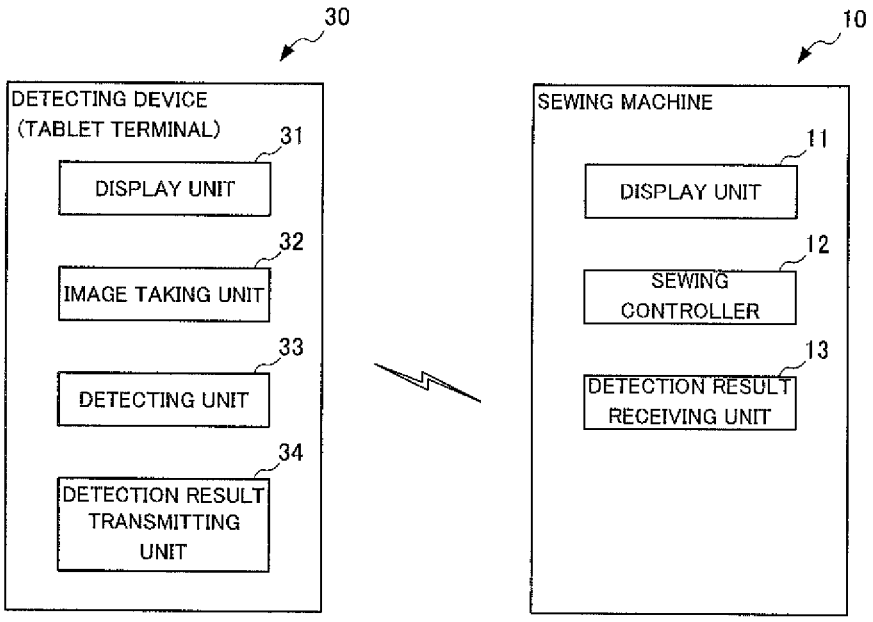
FIG. 2 is a block diagram illustrating a control structure of a sewing machine 10 and a tablet terminal 30.

FIG. 2 is a block diagram illustrating a control structure of a sewing machine 10 and a tablet terminal 30.

Throughout the drawings including FIG. 1, illustrated diagrams are schematic, and sizes and shapes of components are shown out of proportion as appropriate in order to facilitate understanding.

Further, while specific values, shapes, and materials are taken as an example in the following description, these values, shapes, and materials may be changed appropriately.

The sewing machine system of the first embodiment includes the sewing machine 10, a container case 20, and the tablet terminal 30 as a detecting device, and has a function of a thread spool search support system for supporting searching of a thread spool.

The sewing machine 10 is able to do embroidery semi-automatically according to embroidery data using threads of a plurality of colors.

The sewing machine 10 includes a display unit 11, a sewing controller 12, and a detection result receiving unit 13.

The display unit 11 displays various operating statuses, operational guidance, and the like of the sewing machine 10. The display unit 11 of this embodiment is also configured as a touch panel, and functions as an operating unit.

The sewing controller 12 controls a sewing operation of the sewing machine 10 in an integrated manner. The sewing controller 12 is configured using a CPU that operates according to a program recorded in an ROM that is not depicted.

The detection result receiving unit 13 wirelessly communicates with the tablet terminal 30, and receives a detection result that will be described later. Here, any method may be used for the wireless communication.

In addition to the above described components, various other components required to realize a function as a sewing machine are provided for the sewing machine 10. However, such components are the same as those for conventional embroidery sewing machines, and descriptions for such components shall be omitted.

Figure 3:
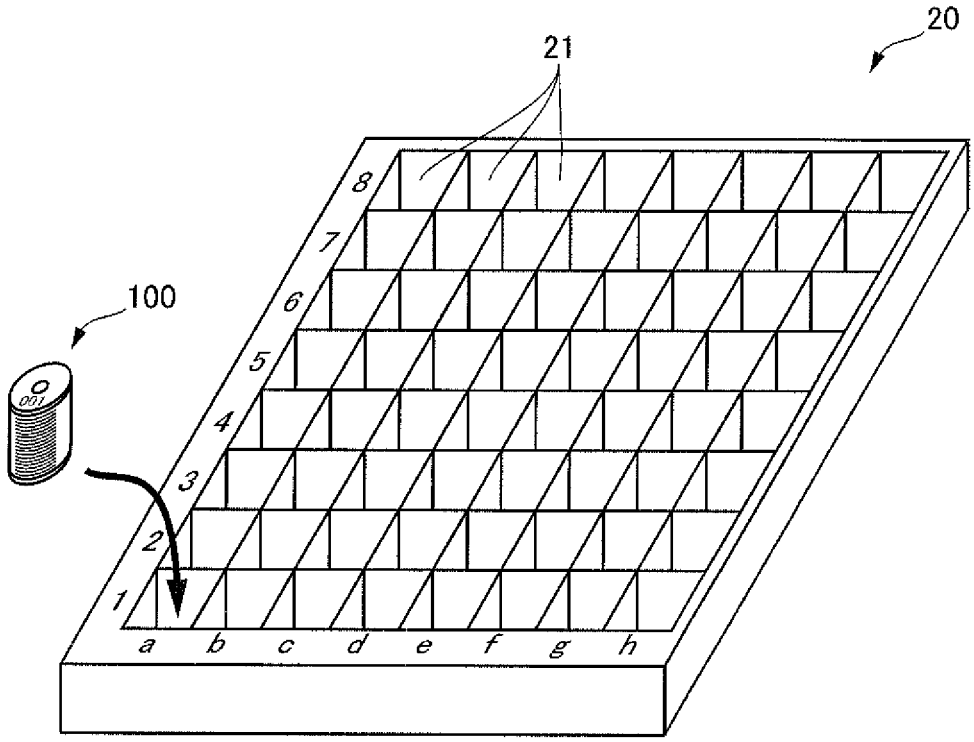
FIG. 3 is a perspective view illustrating a container case 20.

FIG. 3 is a perspective view illustrating the container case 20.

The container case 20 is configured in a shape of a box having containers 21 as a plurality of cells partitioned in a grid pattern so that each cell contains one of thread spools 100. The container case 20 according to this embodiment is provided with the containers 21 of 8 columns and 8 lines, e.g., total 64. On sides of the container case 20, alphabetical characters from a to h indicating columns, and numbers from 1 to 8 indicating lines are imprinted or printed as positional indications for specifying positions of the containers. Based on a combination of the positional indications, that is, a combination of a line and a column, positions of the contained thread spools may be specified as in a score sheet for a chess game.

As the tablet terminal 30, it is possible to use a general-purpose product that is usually commercially available. In order to use the tablet terminal 30 as a detecting device in this embodiment, a program for the sewing machine system is installed in the tablet terminal 30 and executed. The program may be recorded in a recording medium such as a flash memory device or the like, or may be available by downloading through various known networks.

The tablet terminal 30 includes a display unit 31, an image taking unit 32, a detecting unit 33, and a detection result transmitting unit 34.

The display unit 31 is a display unit also functioning as a touch panel that is originally provided for the tablet terminal 30.

The image taking unit 32 is a camera unit that can take a still image or a video image. In this embodiment, after starting up a program for this system (application), the image taking unit 32 is controlled by this program to take an image. The image taking unit 32 takes an image of the container case 20 containing the thread spools 100. Regarding a composition (framing) when an image is taken, it is desirable to take the container case from above so that an entire image of the container case can be taken. The program may guide the framing so that the positional indications are reliably contained within a range of a taken image. In addition, regarding actual image taking, it is possible to employ a common method of taking an image by a photographer touching a shutter button, or an image may be automatically taken when the positional indications are reliably contained within the range of a taken image.

The detecting unit 33 detects a type of each of the thread spools contained in the containers 21 and a contained position of the thread spool in the container case 20 in association with each other based on a result of an image taken by the image taking unit 32. Specifically, the detecting unit 33 analyzes the result of the image taken by the image taking unit 32, recognizes each of a plurality of thread spools 100 contained in the containers 21 of the container case 20, and determines the line and the column at which each thread spool 100 is contained. On an end surface of each thread spool 100, a thread number corresponding to a color of the thread is shown. The thread number is a type indication by which a type of a thread spool may be specified. The detecting unit 33 recognizes characters of the thread number based on the result of the taken image. The detecting unit 33 also recognizes characters of the positional indications. While the description herein only focuses on the color of the thread, examples of the type indication may include other parameters such as a diameter of the thread.

Further, the detecting unit 33 generates a "thread number/line-column address number" conversion table based on the image analysis including such character recognition processing. The "thread number/line-column address number" conversion table is generated as a character string information indicating the types of the thread spools 100 as well as the line and the column at which each thread spool 100 is contained.

The detection result transmitting unit 34 transmits the "thread number/line-column address number" conversion table as the detection result detected by the detecting unit 33 to the sewing machine 10 by wireless communication.

Next, an operation of the sewing machine system of supporting searching of a thread spool will be described.

Figure 4:
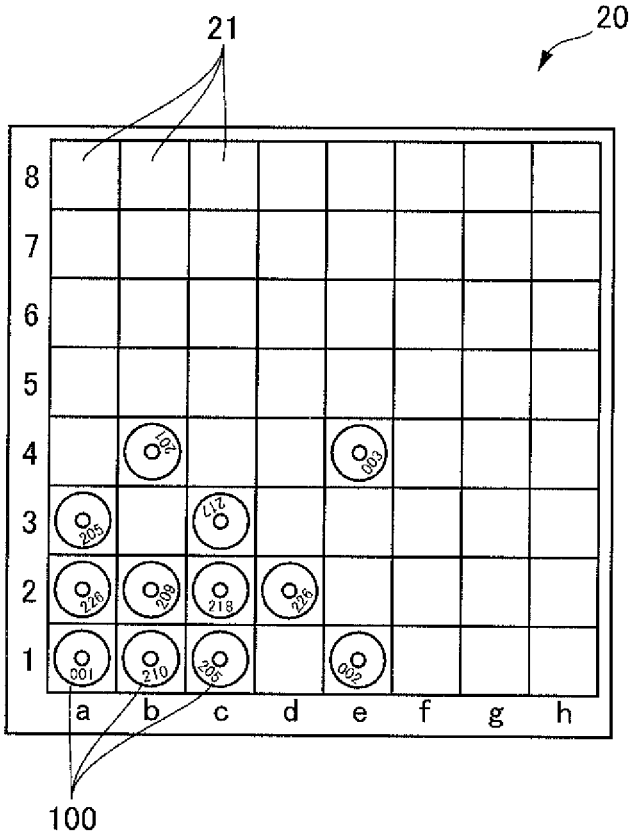
FIG. 4 is illustration of one example of a state in which a plurality of thread spools 100 are contained in the container case 20.

FIG. 4 is illustration of one example of a state in which the plurality of thread spools 100 are contained in the container case 20.

In the sewing machine system of this embodiment, the thread spools 100 may be used in a state as illustrated in FIG. 4 in which any number of the thread spools 100 may be contained at any positions of the container case. More specifically, the thread spools 100 may not necessarily fill all of the containers 21, and there may be an open container. Further, each of the thread spools 100 may face any direction as long as the thread number is visible, and its thread number may be upside down or facing side. Moreover, it is not necessary to arrange the thread spools 100 in order. Furthermore, the thread spools 100 may include a thread spool that is not necessary for sewing as long as the thread spools 100 include all thread spools that are required for sewing.

When the thread spools 100 are contained in the container case 20 and prepared as in the example of FIG. 4, a user starts the program for this system installed in the tablet terminal 30.

Figure 5:
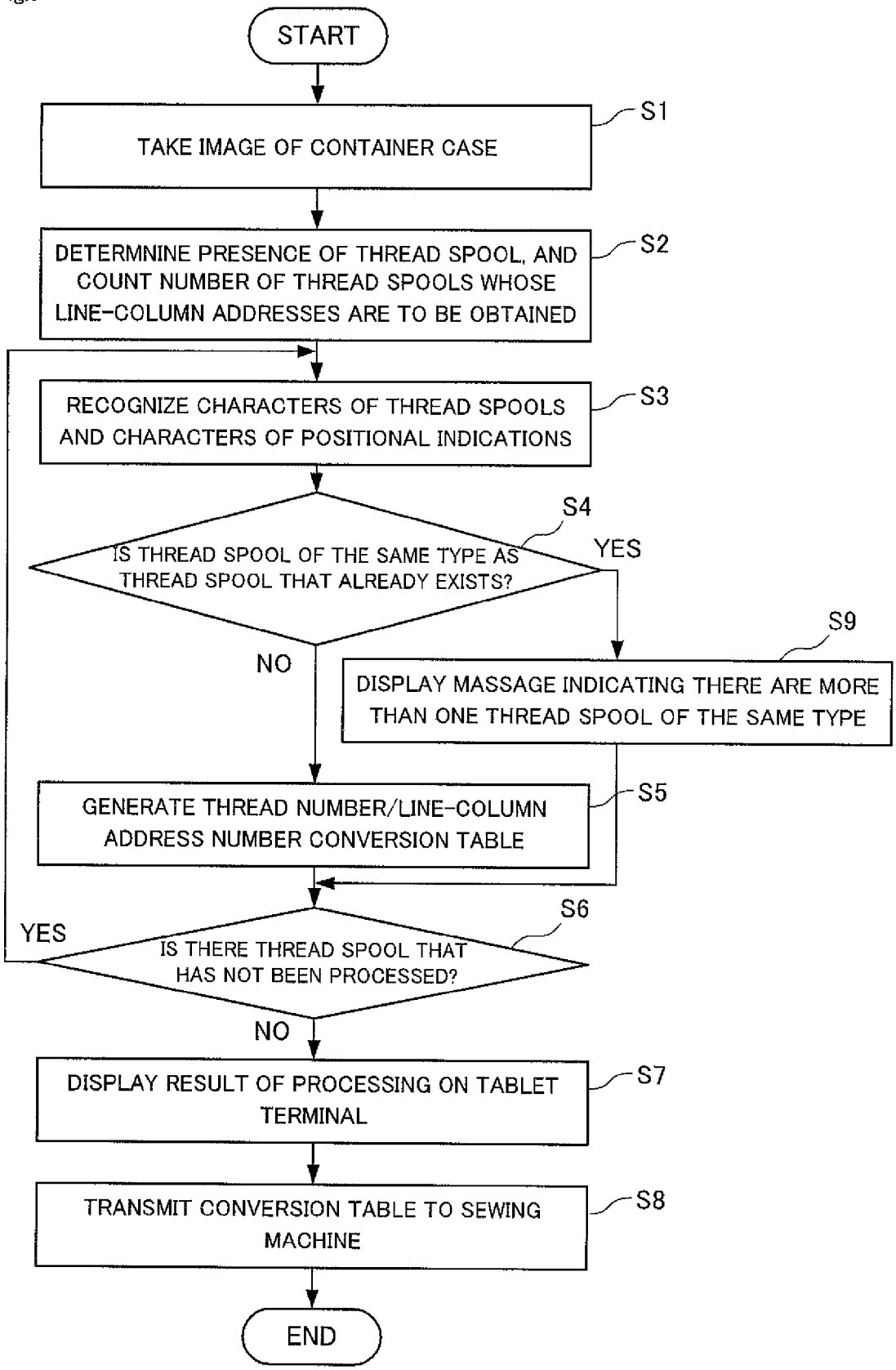
FIG. 5 is a flowchart showing an operational flow of a program for a system of the present invention, the program being installed in the tablet terminal 30.

FIG. 5 is a flowchart showing an operational flow of the program for this system installed in the tablet terminal 30.

In Step 1 (hereinafter referred to as S1), the detecting unit 33 controls the image taking unit 32 to take an image of the container case 20. At this time, the display unit 31 of the tablet terminal 30 displays such as guidance for taking an image, and supports a user so that the user is able to take an image appropriately.

When an image is taken appropriately, image data in a state shown in FIG. 4 is obtained.

In S2, the detecting unit 33 analyzes the image to confirm presence of the thread spools 100, and counts the number of the thread spools 100 whose line and column addresses are to be obtained. In the example shown in FIG. 4, the number of the thread spools is counted as 12.

In S3, the detecting unit 33 recognizes characters representing the thread number of each of the thread spools 100, and characters of the positional indications for a position corresponding to this thread spool.

In S4, it is determined whether or not this thread spool is of the same type as a thread spool that already exists (that has been recognized). Specifically, it is determined whether or not the thread number of the thread spool 100 recognized in S3 is the same as that of the thread spool 100 that already exists (that has been recognized). If this thread spool is of the same type as the thread spool that already exists, the process moves to S9 and a massage indicating there are more than one thread spool of the same type is displayed in the display unit 31. Then, the process moves to S6. On the other hand, if the thread spool is not of the same type as the thread spool that already exists, the process moves to S5.

In S5, the detecting unit 33 generates the "thread number/line-column address number" conversion table.

FIG. 6 is an example of the "thread number/line-column address number" conversion table generated for the example shown in FIG. 4. For the thread spools of the same type, one of them is selected and the other is excluded. Therefore, as shown in FIG. 6, the thread number and the line-column address number correspond one on one.

In S6, presence of the thread spool 100 that has not been processed is confirmed. If there is the thread spool 100 that has not been processed, the process moves to S3, and if all of the thread spools 100 have been processed, the process moves to S7.

In S7, a result of the processing is displayed in the display unit 31 of the tablet terminal 30.

FIG. 7 is a display example in the tablet terminal 30.

In the display unit 31 of the tablet terminal 30, strings of characters of the thread numbers that have been converted are displayed by computer-generated graphics simulating the container case 20.

The thread spool that has been determined as being one of more than one thread spool in S4 and S9 is displayed grayed out.

In S8, the detection result transmitting unit 34 transmits the conversion table as a detection result to the sewing machine 10.

In response to the processing in S8, on the side of the sewing machine 10, the detection result receiving unit 13 receives the conversion table as the detection result, and records the conversion table in a temporary memory area, not shown, of the sewing machine 10.

The preparation before starting sewing is completed by the processing thus far, and it is not necessary to use the tablet terminal 30 for the sewing after this.

Next, an operation of the sewing machine 10 after starting sewing will be described.

Upon starting sewing, the sewing controller 12 starts sewing according to a design that has been set. The sewing controller 12 first displays the thread number of a color to be first used in the sewing in the display unit 11, and also displays a line-column address of a thread spool that corresponds to this thread number in the display unit 11.

Figure 8:
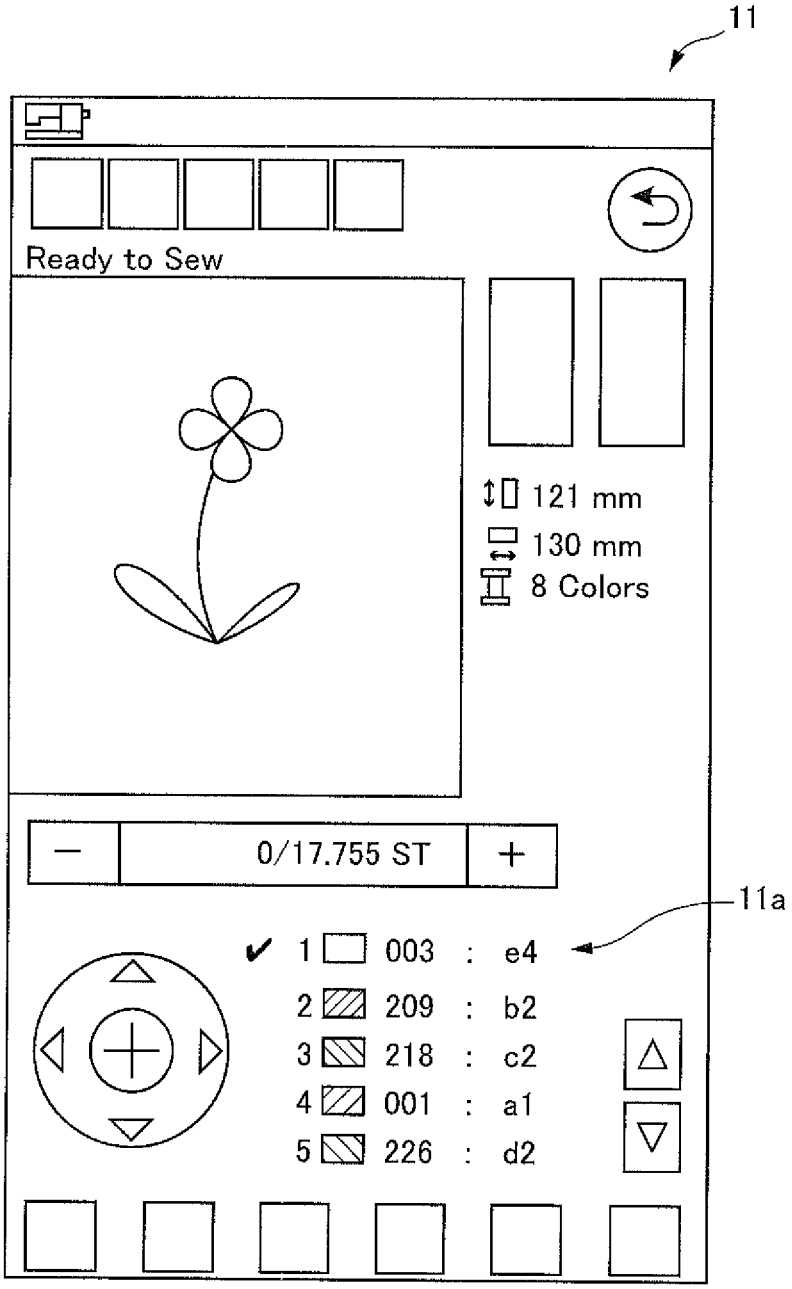
FIG. 8 is a display example in a display unit 11.

FIG. 8 is a display example in the display unit 11.

In an example shown in a display area 11*a*, it is displayed that a thread number first required is "003" and its line-column address is e4. Further, in the example shown in FIG. 8, a check mark indicating the thread number that will be used after this is shown next to the thread number. In the example shown in FIG. 8, a thread number next required is "209" and its line-column address is b2. A thread number required third is "218" and its line-column address is c2. A thread number required fourth is "001" and its line-column address is a1. A thread number required fifth is "226" and its line-column address is d2.

As the sewing progresses, the sewing controller 12 automatically stops the operation temporarily for changing the thread. At this time, the check mark in FIG. 8 sequentially moves to a position next to the thread number of which the thread is next changed. Therefore, the user is able to easily find the desired thread spool 100 in the container case 20 by confirming the thread number and its line-column address that are displayed. For example, if the required thread number is 003 as illustrated in FIG. 8, in order to find the thread of this number in the thread spool container case, the user knows that the thread spool is taken out from the container at a fourth line of a column e, and is able to easily find the thread spool 100.

As described above, according to this embodiment, the preparation is completed only by arranging the thread spools 100 randomly with the indications of the thread numbers upside in the container case 20 having the containers arranged in a grid pattern, and taking an image by the camera using the predetermined program of the tablet terminal 30. Then, when performing embroidery, the line-column addresses of the container case 20 are respectively shown with the corresponding thread numbers. By referring to the line-column address, the user is able to easily find the desired thread spool 100 in the container case 20.

In this manner, according to this embodiment, the sewing machine system facilitates searching of a required thread spool when the thread is changed during sewing. Further, according to this embodiment, as a general-purpose tablet terminal is used, the sewing machine system does not require a large device or the like, and may be easily implemented.

Second Embodiment

Figure 9:
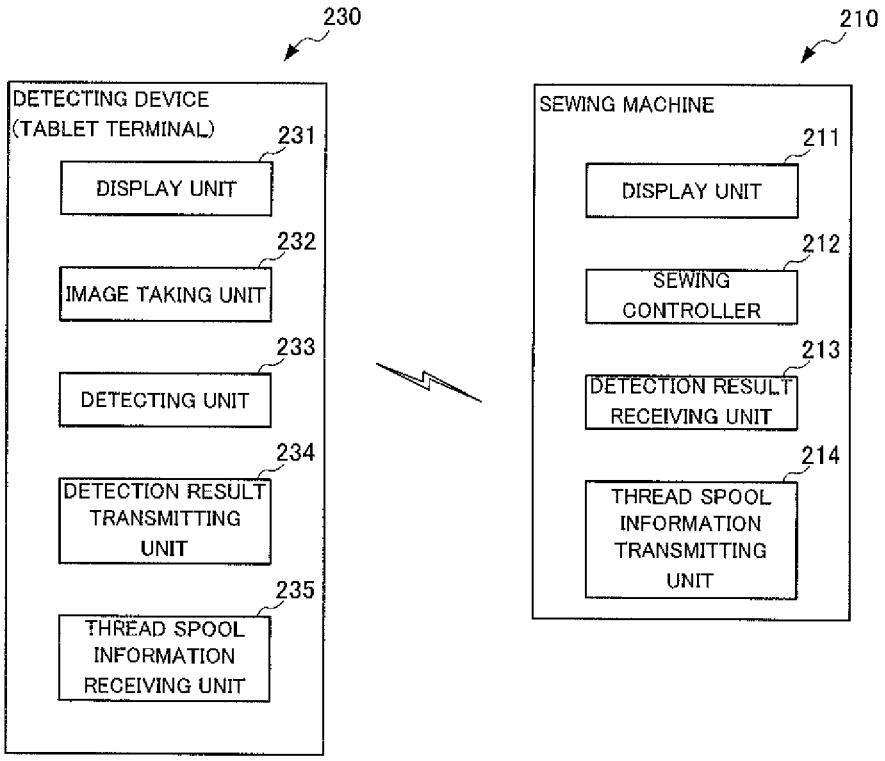
FIG. 9 is a block diagram illustrating a control structure of a sewing machine 210 and a tablet terminal 230 according to a second embodiment.

FIG. 9 is a block diagram illustrating a control structure of a sewing machine 210 and a tablet terminal 230 according to a second embodiment.

The sewing machine system of the second embodiment is in the same configuration as that of the first embodiment other than that the control structure of the sewing machine 210 and the tablet terminal 230 is partially different. Therefore, like components that serve like functions as in the first embodiment are denoted by reference numerals with postfix of like numbers, and repetitive descriptions shall be omitted appropriately.

The sewing machine 210 of the second embodiment includes a display unit 211, a sewing controller 212, a detection result receiving unit 213, and a thread spool information transmitting unit 214.

The display unit 211, the sewing controller 212, and the detection result receiving unit 213 are the same as the display unit 11, the sewing controller 12, and the detection result receiving unit 13 in the first embodiment.

The thread spool information transmitting unit 214 transmits information including the thread number of the thread to be changed, or the thread number and the line-column address of the thread to be changed to the tablet terminal 230 every time the thread is changed under control of the sewing controller 212.

The tablet terminal 230 of the second embodiment includes a display unit 231, an image taking unit 232, a detecting unit 233, a detection result transmitting unit 234, and a thread spool information receiving unit 235. The display unit 231, the image taking unit 232, the detecting unit 233, and the detection result transmitting unit 234 are the same as the display unit 31, the image taking unit 32, the detecting unit 33, and the detection result transmitting unit 34 in the first embodiment.

The thread spool information receiving unit 235 receives the information including the thread number and the line-column address of the thread to be changed from the thread spool information transmitting unit 214.

Upon reception of the information including the thread number and the line-column address of the thread to be changed, this information is displayed in the display unit 231 of the tablet terminal 230. At this time, the position at which the thread spool 100 to be changed is contained may be highlighted by computer-generated graphics simulating the container case 20 as illustrated in FIG. 7.

Further, in the second embodiment, as the display unit 231 of the tablet terminal 230 may be actively utilized, the same effects as in the first embodiment may be achieved, even if the display unit of the sewing machine 210 is simplified or a display unit is not provided for the sewing machine for example.

As described above, according to the second embodiment, it is possible to further simplify the display unit on the side of the sewing machine.

Third Embodiment

Figure 10:
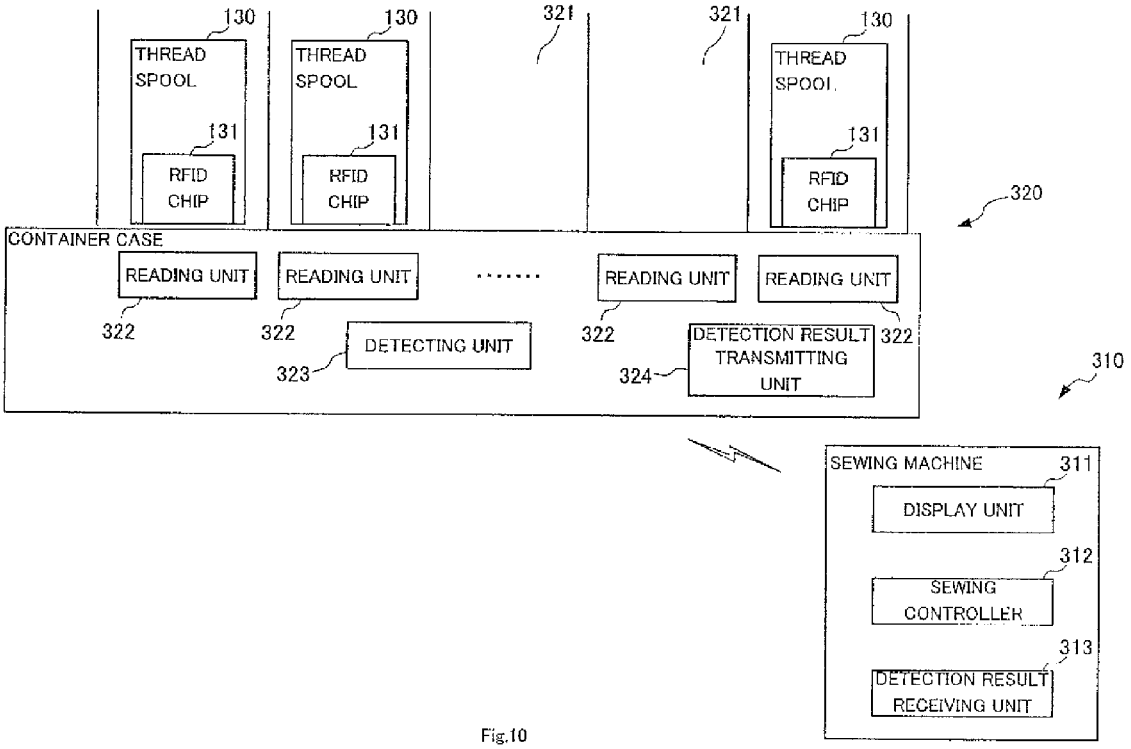
FIG. 10 is a block diagram illustrating a control structure of a sewing machine 310 and a container case 320 according to a third embodiment.

FIG. 10 is a block diagram illustrating a control structure of a sewing machine 310 and a container case 320 according to a third embodiment.

The sewing machine system of the third embodiment is in the same configuration as that of the first embodiment other than that the configuration of the container case 320 is different and a tablet terminal is not required. Therefore, like components that serve like functions as in the first embodiment are denoted by reference numerals with postfix of like numbers, and repetitive descriptions shall be omitted appropriately.

The container case 320 is in the same external shape as that of the container case 20 in the first embodiment, but different from the container case 20 in that the container case 320 is provided with reading units 322 inside, a detecting unit 323, and a detection result transmitting unit 324. The container case 320 is additionally provided with a power supply unit for supplying power necessary for an operation of these components. The power supply unit may be a battery or a unit that supplies power from outside.

The number of the provided reading units 322 is 64 so as to correspond to the 64 containers 321, and each of the reading units is disposed near the bottom of each container.

In this embodiment, thread spools 130 each having an RFID chip 131 inside is used. The RFID chip 131 stores information relating to a thread number or a thread color of the corresponding thread spool 130. When the thread spool 130 is contained in the container 321, the reading unit 322 corresponding to this container 321 and the RFID chip 131 is able to communicate with each other, and the reading unit 322 obtains the information from the RFID chip 131.

The detecting unit 323 sorts out the information received from each of the reading units 322, and generates a "thread number/line-column address number" conversion table as character string information indicating a column and a line of a position at which each of the thread spools 100 is contained.

The detection result transmitting unit 324 transmits the "thread number/line-column address number" conversion table generated by the detecting unit 323 to the sewing machine 310.

The sewing machine 310 includes a display unit 311, a sewing controller 312, and a detection result receiving unit 313 similarly to the sewing machine 10 of the first embodiment. The sewing machine 310 that has received the "thread number/line-column address number" conversion table from the container case 320 performs the similar operation as the sewing machine 10 of the first embodiment, and displays a required thread number in the display unit 311 when the thread is required to be changed, and also displays a line-column address of a thread spool that corresponds to this thread number in the display unit 311.

Further, in the third embodiment, it is possible to continue monitoring of the thread spools 130 by the reading units 322 after starting sewing, and the "thread number/line-column address number" conversion table may be updated in real time during sewing in addition to the generation of the table before sewing. With this, it is possible to always use a latest conversion table and display correctly even if any of the thread spools 130 is moved, added, or removed during sewing.

As described above, in the third embodiment, the user does not have to carry out the operation of taking an image that is required in the first embodiment. Therefore, according to the third embodiment, it is possible to further improve convenience of the sewing machine system.

Modified Examples

The present invention is not limited to the embodiments described above, and various modifications and applications are also included within the scope of the present invention.

In the embodiments described above, the example in which the thread number is indicated on each thread spool is described. However, the present invention is not limited to such an example, and a name of the color in place of the thread number may be indicated on each thread spool, for example, and the name of the color may be recognized, or it is possible to use either of the thread number and the name of the color.

In the embodiments described above, the example in which the thread number indicated on the label of each thread spool is recognized is described. However, the present invention is not limited to such an example, and a barcode or a two-dimensional code provided for each thread spool may be recognized, for example. With this, it is possible to further facilitate the recognition with reliability.

In the embodiments described above, the example in which the alphabetical characters and the number are read as the positional indication is described. However, the present invention is not limited to such an example, and it is possible to recognize the thread spools contained in the cells of the thread spool container case by analyzing an image, and to recognize an order of each of the thread spools from the right bottom to a leftward direction or in a vertical direction, for example. In this case, an orientation of the container case 20 may be read based on the alphabetical characters and the numbers.

In the first embodiment and the second embodiment, the example in which the tablet terminal is used as the detecting device is described. However, the present invention is not limited to such an example, and a mobile phone, a portable video game player, or the like may be used as the detecting device, for example.

In the third embodiment, the sewing machine 310 may also be provided with a reading unit and manage an amount of usage of the thread.

It should be noted that it is possible to realize the detecting device of the sewing machine system according to the present invention by recording the processing of the detecting device of the sewing machine system in a computer-readable recording medium, having the detecting device read the program recorded in the recording medium, and having the program be executed. As used herein, the computer includes an OS and hardware such as peripheral devices.

While a detailed description is not provided, the first embodiment to the third embodiment as well as the modified examples may be used in an appropriate combination. Further, the present invention is not limited to the embodiments described above.

DESCRIPTION OF REFERENCE NUMERALS

10; Sewing Machine
11; Display Unit
11*a*; Display Area
12; Sewing Controller
13; Detection Result Receiving Unit
20; Container Case
21; Container
30; Tablet Terminal
31; Display Unit
32; Image Taking Unit
33; Detecting Unit
34; Detection Result Transmitting Unit
100, 130; Thread Spool
131; RFID Chip
210; Sewing Machine
211; Display Unit
212; Sewing Controller
213; Detection Result Receiving Unit
214; Thread Spool Information Transmitting Unit
230; Tablet Terminal
231; Display Unit
232; Image Taking Unit
233; Detecting Unit

234; Detection Result Transmitting Unit
235; Thread Spool Information Receiving Unit
310; Sewing Machine
311; Display Unit
312; Sewing Controller
313; Detection Result Receiving Unit
320; Container Case
321; Container
322; Reading Unit
323; Detecting Unit
324; Detection Result Transmitting Unit

The invention claimed is:

1. A sewing machine system comprising:

a sewing machine that forms stitching;

a container case provided separately from the sewing machine, and having a plurality of containers partitioned in a grid pattern;

a detecting unit configured to detect a type of a thread spool contained in any of the containers and a contained position of the thread spool in the container case in association with each other;

a detection result transmitting unit configured to transmit a result of the detection by the detecting unit to the sewing machine;

a detection result receiving unit provided for the sewing machine, and configured to receive the detection result from the detection result transmitting unit; and a display unit configured to display, based on the detection result, a type of a thread spool to be required during sewing and a contained position of the thread spool in the container case.

2. The sewing machine system according to claim 1, wherein the display unit is provided for the sewing machine.

3. The sewing machine system according to claim 1, wherein the detecting unit and the detection result transmitting unit are provided for the container case, and the detecting unit includes reading units respectively provided for the containers, and by the reading units respectively communicating with RFID chips each provided for thread spools contained in the container case, detects a type of a thread spool contained in any of the containers and the contained position of the thread spool in the container case in association with each other.

4. The sewing machine system according to claim 1, wherein the detecting unit and the detection result transmitting unit are provided for a detecting device separate from the container case and the sewing machine, the detecting device includes an image taking unit configured to take an image of positional indications for specifying positions of the containers of the container case, and of a type indication shown on a thread spool contained in the container and for specifying a type of the thread spool, and the detecting unit detects, using a result of the image taken by the image taking unit, the type of the thread spool contained in any of the containers and the contained position of the thread spool in the container case in association with each other.

5. The sewing machine system according to claim 4, wherein the sewing machine includes a thread spool information transmitting unit configured to transmit information relating to the type of the thread spool to be required during sewing and the contained position of the thread spool in the container case to the detecting device, the detecting device includes:

a thread spool information receiving unit configured to receive the information from the thread spool information transmitting unit; and a display unit configured to display, based on the information received by the thread spool information receiving unit, the type of the thread spool to be required during sewing and the contained position of the thread spool in the container case.

6. A non-transitory computer-readable storage medium storing a program for causing a detecting device of the sewing machine system as defined in claim 2 to be operated, the program causing a computer to execute the steps of:

causing the image taking unit to take an image of positional indications for specifying positions of the containers of the container case, and of a type indication shown on a thread spool contained in the container and for specifying a type of the thread spool;

causing the detecting unit to detect, using a result of the image taken by the image taking unit, the type of the thread spool contained in any of the containers and the contained position of the thread spool in the container case in association with each other; and causing the detection result transmitting unit to transmit a result of the detection by the detecting unit to the sewing machine.

7. A sewing machine provided for a sewing machine system including:

the sewing machine that forms stitching;

a container case provided separately from the sewing machine, and having a plurality of containers partitioned in a grid pattern;

a detecting unit configured to detect a type of a thread spool contained in any of the containers and a contained position of the thread spool in the container case in association with each other; and a detection result transmitting unit configured to transmit a result of the detection by the detecting unit to the sewing machine, the sewing machine comprising:

a detection result receiving unit configured to receive the detection result from the detection result transmitting unit; and a display unit configured to display, based on the detection result, a type of a thread spool to be required during sewing and a contained position of the thread spool in the container case.

* * * * *